US008220314B2

(12) United States Patent
McDonough et al.

(10) Patent No.: US 8,220,314 B2
(45) Date of Patent: Jul. 17, 2012

(54) LIGHTER DEVICE WITH FLOW RESTRICTOR AND METHODS OF MANUFACTURING AND TESTING SAME

(75) Inventors: James M. McDonough, East Greenwich, RI (US); Ronald J. Meister, Bradford, PA (US); Michael W. Johnson, Port Allegany, PA (US)

(73) Assignee: Zippo Manufacturing Company, Bradford, PA (US)

( * ) Notice: Subject to any disclaimer, the term of this patent is extended or adjusted under 35 U.S.C. 154(b) by 283 days.

(21) Appl. No.: 12/754,474

(22) Filed: Apr. 5, 2010

(65) Prior Publication Data

US 2010/0186233 A1 Jul. 29, 2010

Related U.S. Application Data

(62) Division of application No. 11/549,582, filed on Oct. 13, 2006, now Pat. No. 7,690,242.

(60) Provisional application No. 60/596,731, filed on Oct. 17, 2005.

(51) Int. Cl.
*G01M 3/02* (2006.01)
*G01F 25/00* (2006.01)
*G01P 21/00* (2006.01)

(52) U.S. Cl. ..... 73/37; 73/1.25

(58) Field of Classification Search ..... 73/37, 38, 73/1.16, 1.25, 1.26, 1.35, 861, 195
See application file for complete search history.

(56) References Cited

U.S. PATENT DOCUMENTS

| | | | | |
|---|---|---|---|---|
| 2,293,725 | A * | 8/1942 | Flock et al. | 73/1.25 |
| 2,736,181 | A | 2/1956 | Seibert et al. | |
| 3,860,385 | A | 1/1975 | Nakanishi | |
| 4,235,589 | A | 11/1980 | Vallera | |
| 4,311,450 | A | 1/1982 | Camos | |
| 4,496,309 | A | 1/1985 | Schaechter | |
| 5,996,402 | A | 12/1999 | Harris | |

FOREIGN PATENT DOCUMENTS

| | | |
|---|---|---|
| EP | 0052580 | 5/1982 |
| JP | 55033628 | 3/1980 |
| JP | 55033628 A * | 3/1980 |

OTHER PUBLICATIONS

EP 06825949, Supplementary European Search Report mailed Oct. 12, 2010.

PCT/US06/40192, International Search Report and Written Opinion mailed Sep. 12, 2007.

* cited by examiner

*Primary Examiner* — Hezron E Williams
*Assistant Examiner* — Nathaniel Kolb
(74) *Attorney, Agent, or Firm* — Baker & McKenzie LLP

(57) ABSTRACT

A lighter device having a flow restrictor and associated methods for manufacturing and testing such lighter device and flow restrictor are described. The flow restrictor may be formed of a porous member to achieve a substantially fixed or varying flame height. The flow restrictor may be tested before or after assembly into a lighter housing by receiving a non-combustible fluid therethrough. The flow rate of the non-combustible fluid may be correlated to the flow rate of a combustible fluid through the flow restrictor to approximate the resultant flame height of a lighter incorporating the tested flow restrictor. The flow restrictor may also be tested by receiving a combustible fluid therethrough prior to assembling the flow restrictor into the lighter housing. In this manner, flow restrictors and corresponding lighter devices may be tested without introducing combustible fluids into such lighter devices prior to shipment. Also, a vacuum may be drawn on a fuel tank of the lighter prior to shipment.

9 Claims, 8 Drawing Sheets

LIGHTER DEVICE WITH FLOW RESTRICTOR AND METHODS OF MANUFACTURING AND TESTING SAME

CROSS-REFERENCE TO RELATED APPLICATIONS

This application is a divisional application of U.S. patent application Ser. No. 11/549,582, filed Oct. 13, 2006, and entitled "Lighter device with flow restrictor and methods of manufacturing and testing same," which claims priority to U.S. Provisional Application No. 60/596,731, filed Oct. 17, 2005. Both of these applications are hereby incorporated by reference for all purposes.

BACKGROUND

1. Technical Field

This disclosure relates to lighter devices, and more particularly to "open flame" lighter devices having a flow restrictor. Related methods of manufacturing and testing open flame lighter devices are also described.

2. Description of Related Art

Open flame lighters are commonly used for igniting tobacco products such as cigarettes, cigars, pipes and the like. Such devices lie in contrast to devices in which a flame is entirely or substantially entirely enclosed, for example, for heating. Many open flame lighters utilize pressurized fuel to induce the flame. Such lighters are commonly referred to as "butane" lighters, although the fuel may be only partially butane. As used herein the term "lighter" refers to all open flame-producing portable devices that use a combustible fluid as fuel, commonly known as cigarette lighters, pipe lighters, and/or cigar lighters and such similar devices. Exemplary devices are defined in ASTM Standard F400-04.

Some conventional lighters utilize an adjustable fuel delivery mechanism to allow the flame height to be adjusted within a predetermined range, such as defined in ASTM Standard F400-04, section 3.1.8. Other conventional lighters utilize a fixed fuel delivery mechanism to effect a fixed flame height. With both types of lighters, the maximum flame height is required to be controlled. It has been found necessary to test such lighters to make sure that the maximum flame height does not exceed a predetermined limit. This typically requires disposing a combustible fuel into the lighters and testing the flame height prior to sale. Once the lighter has been filled with fuel, additional restrictions on the shipment of such lighters may be incurred because they may be classified by some entities as hazardous goods. This adds to the cost and difficulty of distributing such lighters in commerce.

SUMMARY

The present disclosure overcomes the cost and difficulty of distributing lighters with fuel by providing an apparatus and method for manufacturing, testing and distributing "dry" lighters having flow restrictors, e.g., lighters having not received a combustible fuel, such as, butane or a butane mixture. An exemplary flow restrictor may be formed of a porous member that regulates the flow of fuel through a valve assembly of the lighter to induce a substantially fixed flame height or a variable flame height. The porous member may be rigid or compressible and may include a single opening or a plurality of openings. The flow restrictor may be tested before or after assembly into a lighter. When tested before assembly, a combustible fuel or a non-combustible fluid (e.g., inert gas) may be directed through the flow restrictor to assess the flow rate. If a non-combustible fluid is used, the flow rate of the non-combustible fluid may be correlated to the flow rate of a combustible fluid (e.g., butane or butane-like mixture) through the flow restrictor to approximate the resultant flame height of a lighter incorporating the tested flow restrictor. When tested after assembly of the flow restrictor into the lighter housing, a non-combustible fluid may be directed through the flow restrictor to assess the flow rate. The flow rate of the non-combustible fluid may be correlated to the flow rate of a combustible fluid through the flow restrictor to approximate the resultant flame height of a lighter incorporating the flow restrictor. In this manner, flow restrictors and corresponding lighter devices may be tested for flame height without introducing combustible fluids into such lighter devices prior to shipment.

Moreover, a vacuum may be drawn on the fuel tank of the lighter prior to shipment. In embodiments where the flow restrictor is tested after assembly into the lighter, the non-combustible fluid may be extracted from the fuel tank and a vacuum drawn thereon. Providing a refillable lighter with a fuel tank under vacuum would facilitate and enhance the initial filling of the tank with fuel by the consumer, allowing for the fuel to enter the tank without the need to compress the air sealed in the tank during normal manufacturing processes. This allows for the consumer to maximize the initial fill of the tank with fuel, while minimizing internal pressure in the fuel reservoir. This is also advantageous in avoiding pressure increases during transport of lighters in hot climates.

BRIEF DESCRIPTION OF THE DRAWINGS

Reference is now made to the following descriptions taken in conjunction with the accompanying drawings, in which.

DETAILED DESCRIPTION

Figure 1:
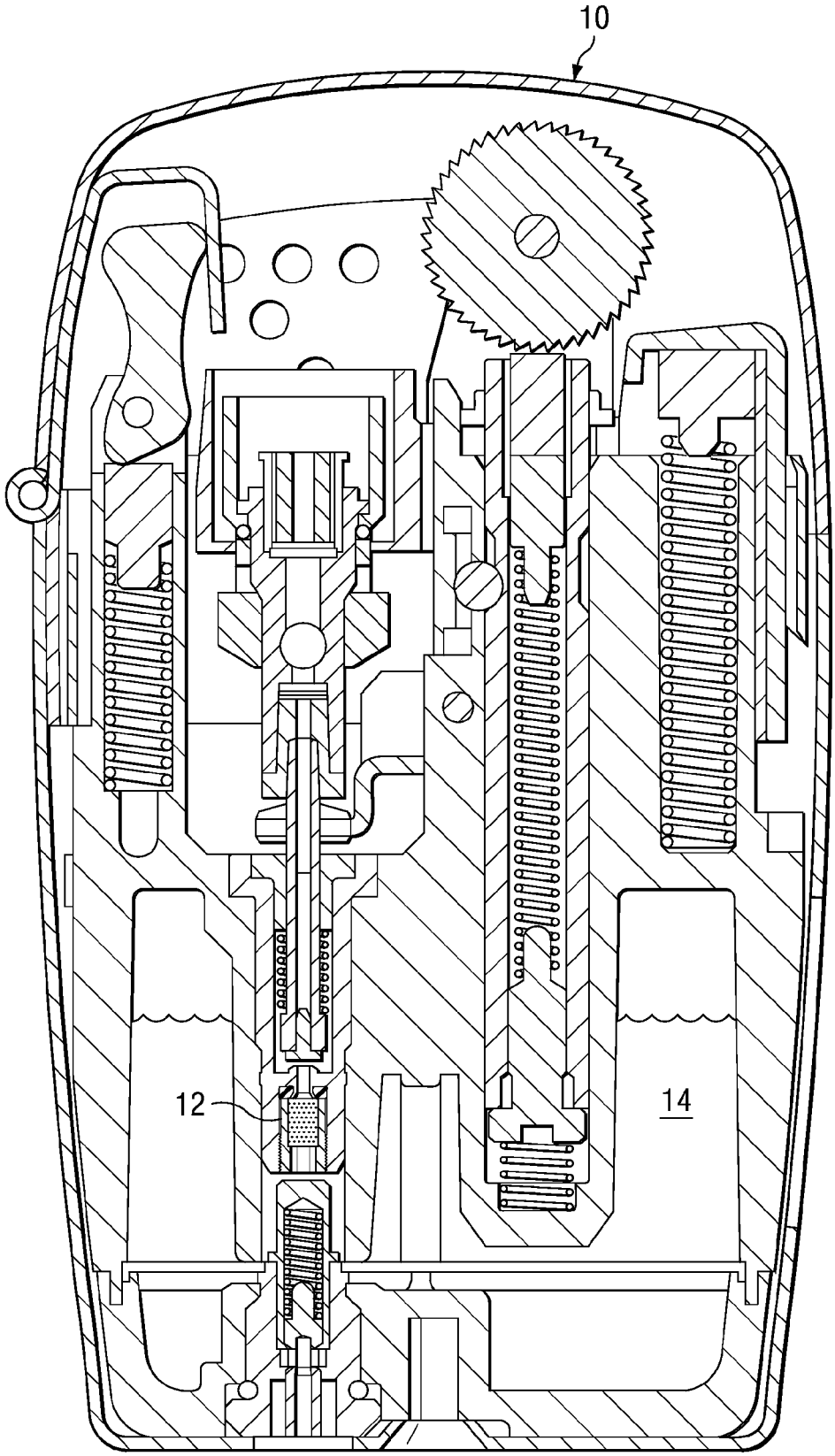
FIG. 1 is a sectional side view of a lighter useful in the practice of the present disclosure.

Referring to FIG. 1, a lighter 10 according to the present disclosure is illustrated. It is to be understood, however, that other forms of lighters may be used as alternatives to the lighter 10 shown in FIG. 1, and that the lighter 10 is presented as an example to illustrate aspects of the present disclosure. Indeed, the lighter 10 may be any lighter device that incorporates a flow restrictor or flow restrictor-like device. The lighter 10 includes a flow restrictor assembly 12, which receives fuel from a fuel storage compartment 14. In practice, a user may initiate a flame by actuating the lighter to induce fluid flow from the storage compartment 14 to and through the flow restrictor assembly 12. As used herein, the term "fluid" refers to fluid in a gaseous state, liquid state, plasma state, or combinations thereof.

Figure 2:
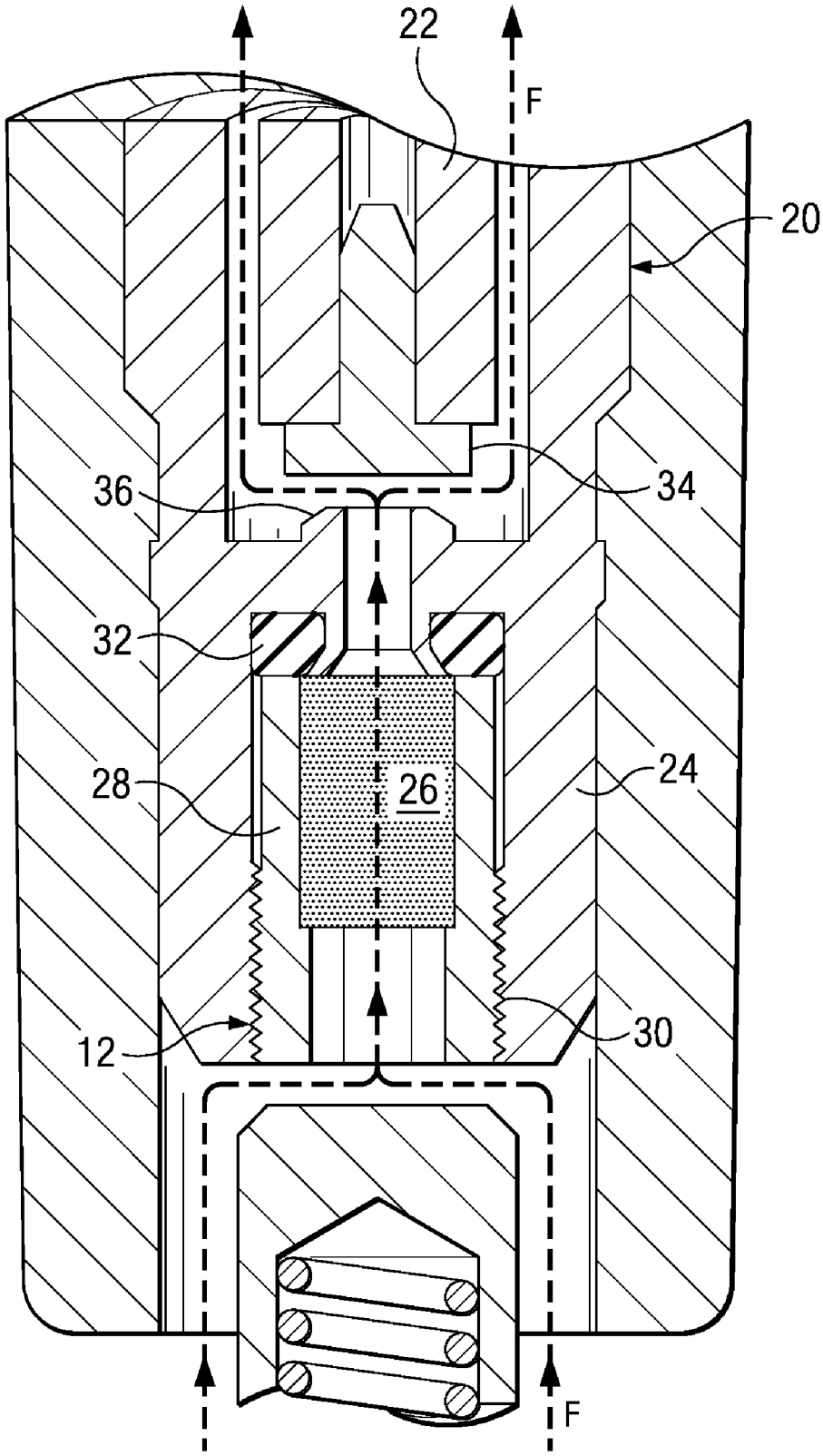
FIG. 2 is an enlarged partial sectional view of a portion of valve assembly of FIG. 1.

FIG. 2 details a portion of a valve assembly 20 of the lighter 10. The valve assembly 20 includes a valve member 22 disposed above the flow restrictor assembly 12, which may be disposed in an interior casing 24 of the lighter 10 such that the flow restrictor assembly 12 lies in an area defined generally adjacent to the storage compartment 14. Accordingly, the lighter 10 defines a fuel flow path F beginning at the storage compartment 14, extending through the flow restrictor assembly 12 and extending upward through the interior casing 24 and past the valve member 22. In other words, the arrows F denote the path and direction of flow. In one embodiment, the flow restrictor assembly 12 includes a flow restrictor 26 disposed within a sleeve 28. In the illustrated embodiment, the flow restrictor 26 is a porous member. The sleeve 28 may be formed of metal and may include a plurality of ridges 30 to securely engage the interior casing 24. The flow restrictor assembly 12 may further include a sealing element, such as an O-ring 32 to seal the fluid flow path. It is to be appreciated that in some embodiments, the flow restrictor assembly 12 may be unitarily formed such that the "assembly" is one integral member.

The flow restrictor 26 may be formed of a variety of materials, including rigid and compressible materials. Exemplary rigid materials include metal, such as stainless steel, and plastic, and may be employed to achieve a fixed flame height. Exemplary compressible materials include elastomeric materials, foams, sponges, and fibrous sheets, and may be employed to achieve variable flame height. For example, the lighter 10 may utilize a screw to compress a porous elastomer flow restrictor, thereby altering fluid flow therethrough when desired. Other rigid and compressible materials are contemplated to fall within the scope of the present disclosure. Furthermore, the flow restrictor 26 may be formed to include a single opening therethrough or a plurality of openings therethrough. In operation, combustible fuel is directed through the flow restrictor 26 to achieve a substantially consistent fluid flow rate therethrough, and to ultimately achieve a desired fixed flame height or a variable flame height falling within a specified range.

The valve member 22 includes a sealing portion 34, which may be actuated to engage a seal seat 36 of the interior casing 24. In operation, the valve member 22 may be actuated downwardly (as viewed in FIG. 2) to engage the sealing portion 34 with the seal seat 36, thereby effectively blocking upward fluid flow (as viewed in FIG. 2).

Figure 3:
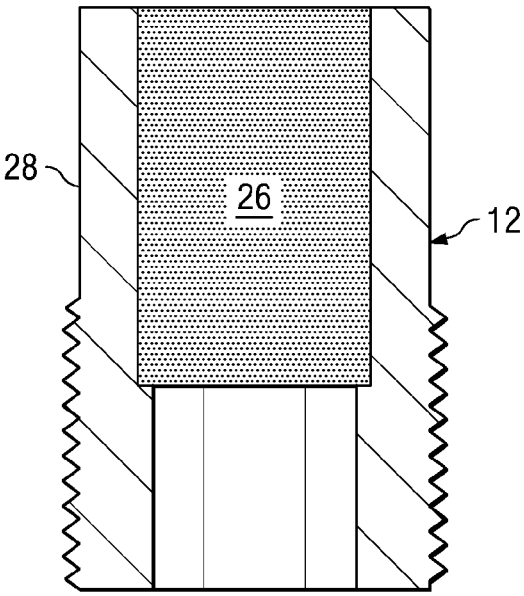
FIG. 3 is an enlarged sectional side view of a flow restrictor useful in the lighter of FIG. 1 and otherwise in the practice of the present disclosure.
Figure 4:
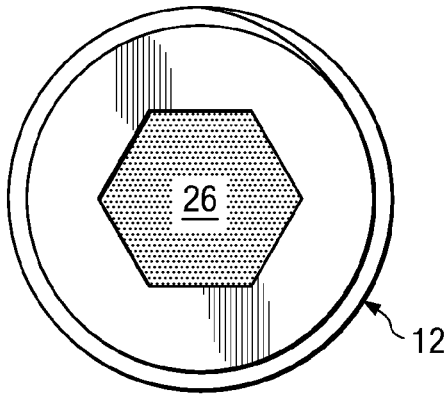
FIG. 4 is a view of the inlet end of the flow restrictor of FIG. 3.
Figure 5:
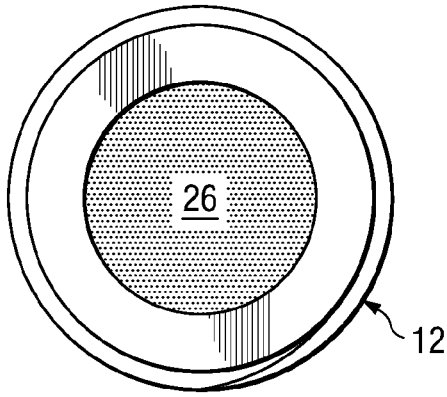
FIG. 5 is a view of the outlet end of the flow restrictor of FIG. 3.

Referring now to FIGS. 3-5, the flow restrictor 26 is shown in more detail to illustrate a plurality of pores, which cooperatively allow passage of butane, butane-component, or butane-like fluid. The flow restrictor 26, in part or in whole, may be a porous media that provides for a continuous release path for the fluid to flow through. The porosity and exposed surface area of the flow restrictor 26 in combination with the properties and conditions of the fluid govern the flow rate of the fluid through the flow restrictor. Such fluid properties and conditions, e.g. density, flow velocity, vapor pressure, and temperature, can affect the resultant flow rate through the flow restrictor. The permeability of the flow restrictor 26 results from its porosity, which is a function of the relative size, shape and number of pores, and the percentage of pores that are connected to form a continuous flow path. It is to be appreciated that the flow restrictor 26 may take on alternative configurations other than a porous configuration so long as the flow restrictor permits fluid flow therethrough in a consistent manner. For example, an alternative flow restrictor may include a tube that restricts the flow of fluid therethrough. In one embodiment, the flow restrictor 26 is manufactured so that the flow therethrough is highly repeatable. By controlling both design and manufacturing parameters of the flow restrictor 26, the fluid flow (particularly for gaseous fluids) is tightly controlled. The flow rate through the flow restrictor 26, and thus the resultant flame height, can be accurately determined via testing of the flow restrictor.

Figure 6:
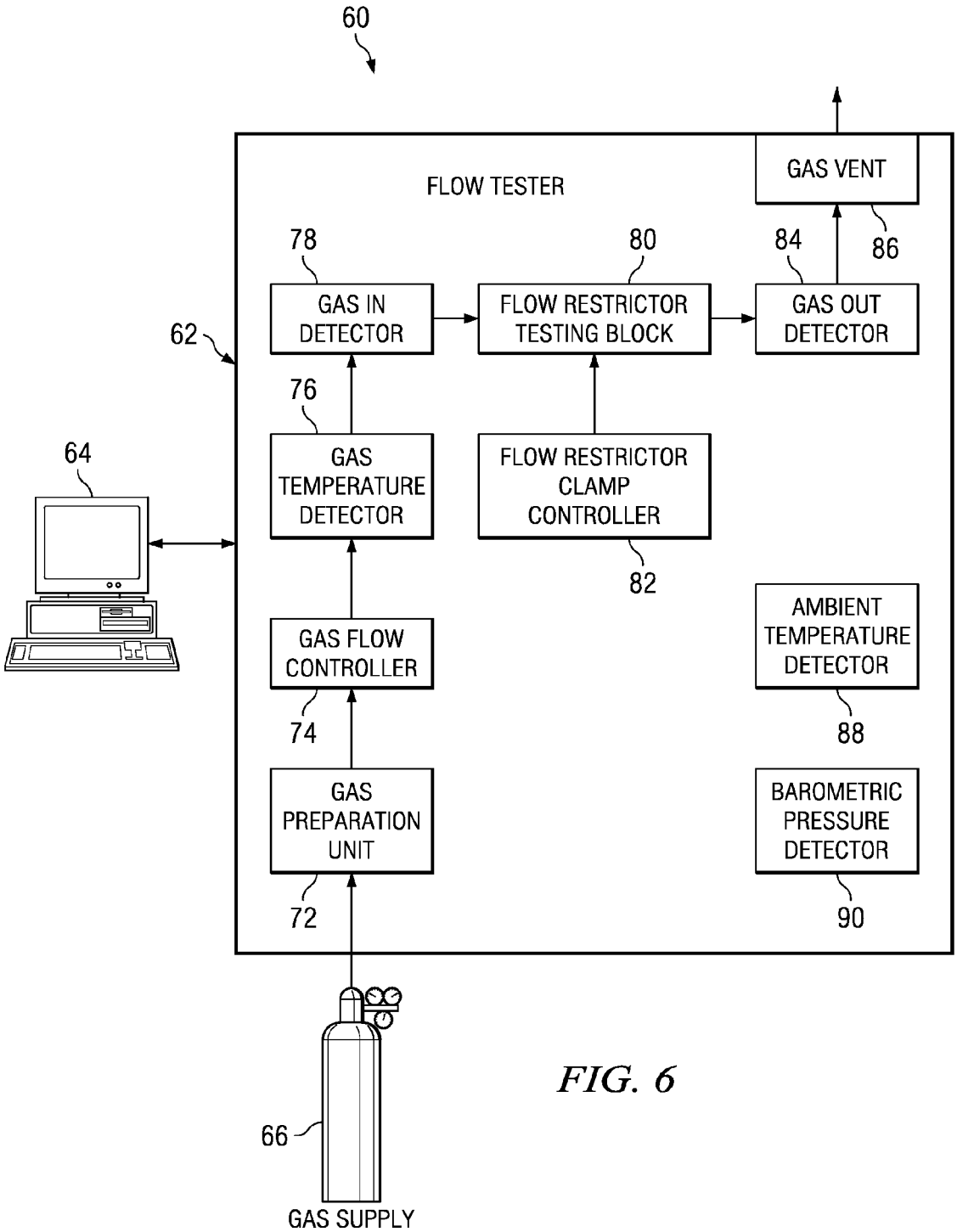
FIG. 6 is a schematic diagram of a flow restrictor testing system useful in the practice of the present disclosure.

Referring now to FIG. 6, in one implementation of the present disclosure, a testing system 60 may be used to test the flow restrictor 26, which may be disposed in flow restrictor testing block 80. Testing system 60 may include a flow tester 62 that measures the flow rate and other parameters of a gas from gas supply 66 through the flow restrictor 26. Although a gas is used to illustrate this embodiment, it should be appreciated that a fluid in another state (e.g., a liquid, plasma, or a combination of states thereof) may be used for testing the flow rate of the flow restrictor. Examples of the gas from gas supply 66 include nitrogen, air or another non-combustible fluid. Testing system 60 may further include a computer 64 to provide a user interface for testing system 60, as well as to run instructions to control and operate the flow tester 62, collect data, calculate, analyze and record results, provide network connectivity to a LAN/WAN, and perform other instructions detailed in the logical flow diagram of FIG. 8.

Testing system 60 can be configured to measure the flow permitted by the flow restrictor 26. In other words, the testing system 60 is configurable to measure the flow rate of the test gas through the flow restrictor 26. The testing system 60 may be used in a temperature/humidity-controlled environment to maintain accurate and consistent results. In other embodiments, the testing system 60 may used in any environment with the computer 64 conditioning and correcting results based on its reading of environmental conditions.

The flow tester 62 may include a gas preparation unit 72, gas flow controller 74, gas temperature detector 76, gas in pressure detector 78, the flow restrictor testing block 80 (for housing the tested flow restrictor 26), flow restrictor clamp controller 82, gas out detector 84, gas vent 86, ambient temperature detector 88, and barometric pressure detector 90. Although the flow tester 62 may sense a fluid flow with fewer components, e.g., just a flow sensor, this exemplary embodiment measures temperature, pressure, and barometric pressure parameters to apply pressure and viscosity corrections to determine a standardized mass flow rate through the flow restrictor 26 being tested.

For example, for nitrogen gas, standard volumetric flow rates are determined using the following formula:

$$M_s = M_O*((P_g+2P_s)*\nu_0*T_0)/((P_g+2P_b)*\nu_s*T_s),$$

where $M_S$ is standardized mass flow, $M_0$ is measured mass flow, $P_g$ is gas pressure in inches of mercury ("Hg), $P_s$ is standard pressure (i.e., 29.92 "Hg at 15° C. and mean sea level), $P_b$ is barometric pressure ("Hg), $\nu_0$ is viscosity of the gas (i.e. $166.4+0.45*T_g$, where $T_g$ is gas temperature), $T_0$ is ambient temperature in Kelvin (i.e., 272+T (° C.), $\nu_s$ is standard viscosity of nitrogen (i.e., 175.9), and $T_s$ is standard temperature (i.e. 294.1K).

Gas supply 66 can be configured to provide flow tester 62 with a non-combustible test gas such as air, or it can be configured to provide combustible fuel, such as butane or a butane-like mixture. Preferably, the gas should be of a high purity that is clean, dry, and free of oil. The gas is received at gas preparation unit 72, which may include an oil/moisture trap to reduce the risk of contamination. The gas then passes to gas flow controller unit 74, which regulates the flow of gas to provide a desired gas pressure. Gas temperature detector unit 76 measures the temperature of the gas ($T_g$), and gas in detector unit 78 may measure the gas pressure prior to passing through the flow restrictor testing block 80.

Figure 7:
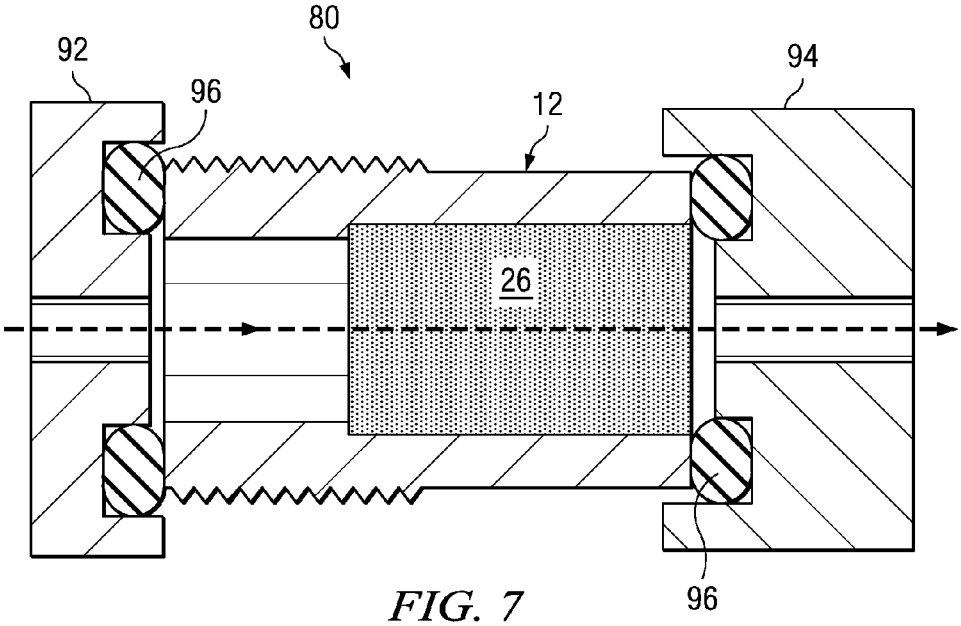
FIG. 7 is a sectional side view of an apparatus for testing the flow restrictor of FIG. 2.

It is to be appreciated that the flow restrictor 26 itself, the flow restrictor assembly 12 or the entire valve assembly 20 may be placed in flow restrictor testing block 80 to perform flow testing. For example, briefly referring to FIG. 7, flow restrictor assembly 12 may be positioned between testing blocks 92, 94 to provide a stable configuration of the flow restrictor for testing. Additionally, a pair of O-rings 96 may be used to seal the interface between the flow restrictor assembly 12 and the testing blocks 92, 94. Further, a clamping apparatus may be used to apply sufficient pressure to effect a seal on the interface between the flow restrictor assembly 12 and the testing blocks 92, 94. In other embodiments, only the flow restrictor 26 may be tested prior to assembly into the lighter 10, or the entire valve assembly 20 may be tested prior to assembly into the lighter 10. Now, referring back to FIG. 6, flow restrictor clamp controller 82 controls the clamping of testing blocks 92, 94 on the flow restrictor 26 to effect a secure seal. Other suitable sealing arrangements and testing apparatus are contemplated, for example, for testing the flow restrictors in an assembled lighter, and for testing a batch of flow restrictors.

A gas out detector 84 may measure the mass flow of gas exiting the flow restrictor 26 to determine the variable $M_O$. The gas is then directed to a gas vent unit 86, where it is either collected, or vented into the atmosphere, according to appropriate environmental disposal requirements of the gas. Ambient temperature detector unit 88 measures the ambient temperature (T), and barometric pressure detector unit 90 measures the barometric pressure ($P_b$).

The measured variables from units 76, 78, 84, 88 and 90 are transmitted to computer 64, which is operable to calculate the flow rate (e.g., volumetric flow rate) through the flow restrictor 26, as well as provide other functions. In embodiments where a non-combustible fluid is used for testing, a known correlation, e.g. vapor pressure, density, temperature, etc., between the non-combustible test fluid (e.g., nitrogen gas) and the combustible fluid (e.g., butane) may be used to extrapolate a predicted fluid flow rate for the combustible fluid through the flow restrictor 26.

Figure 8:
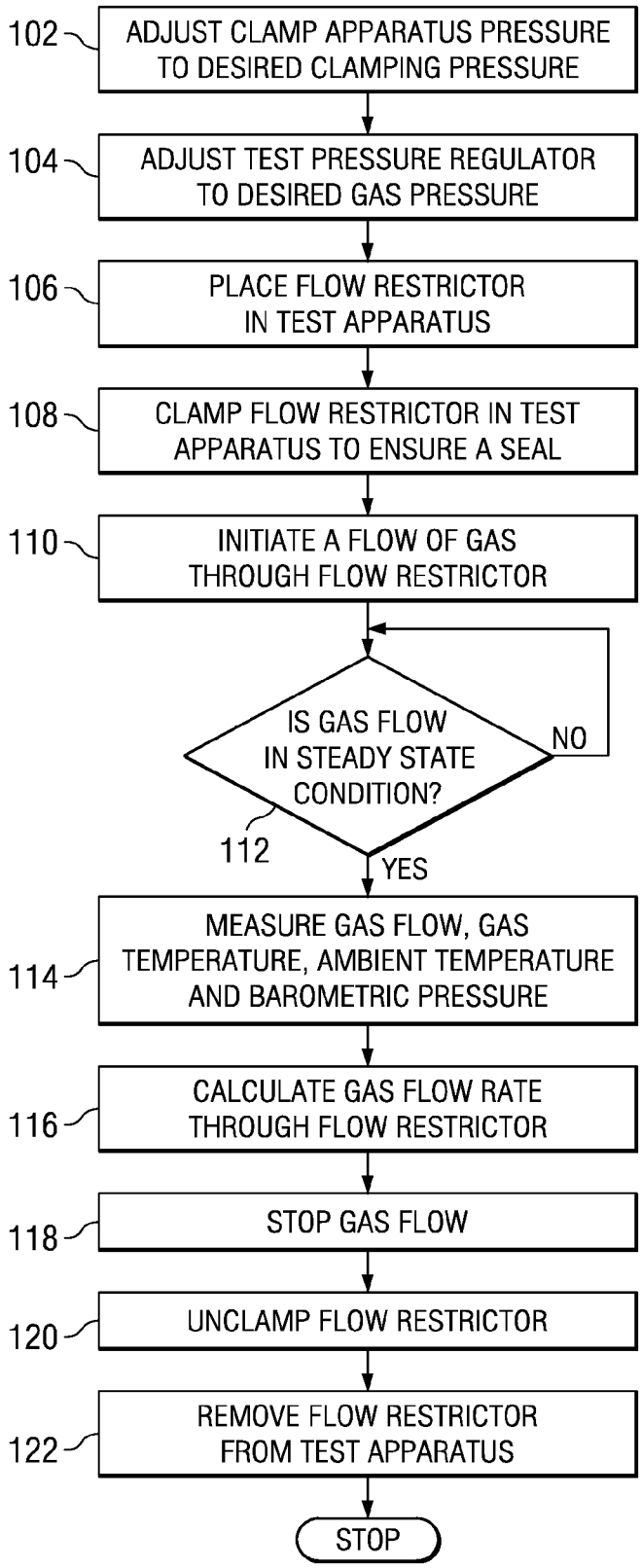
FIG. 8 is a logical flow diagram showing a method for testing the flow restrictor of FIG. 2 useful in the practice of the present disclosure.

FIG. 8 illustrates a logical flow diagram of a method for testing a flow restrictor. A desired clamping pressure is set, at 102. The gas pressure is then regulated to the desired test pressure, at 104. A flow restrictor is inserted into flow restrictor testing block, at 106, and the flow restrictor is clamped to ensure a seal, at 108. The clamping pressure should be sufficient to effect a seal on the flow restrictor to avoid leaks. Next, a flow of gas is initiated through the flow restrictor, at 110. Upon determining that the gas flow is in a steady state condition, at 112, mass flow, gas pressure, gas temperature, ambient temperature, and barometric pressure are measured, at 114. Next, flow rate through the flow restrictor is determined, at 116. Gas flow is then stopped, at 118, and the flow restrictor may be released by unclamping it, at 120, and removing the flow restrictor from the test apparatus, at 122.

In embodiments where a non-combustible fluid is used for testing, the correlation between the test fluid (e.g., air or inert gas) and product fluid (e.g., butane) can be confirmed by taking a sampling of flow restrictors and using the test fluid to determine their individual flow rates using a qualified test instrument. After determining flow rates with the instrument, the flow restrictors may then be assembled into test lighters, which are filled with butane. The test lighters may then be actuated to test for flame height. The results of this testing would give a direct correlation between flow rate of the test fluid and actual flame height, while only filling a few test lighters with butane or butane-like material. It is to be appreciated that in alternative embodiments, the flow restrictors could be tested by measuring pressure differential at a predetermined and controlled pressure and temperature with the particular test fluid.

Accordingly, a determined combustible fuel flow rate or a corresponding flow rate of a non-combustible fluid through the flow restrictor 26 will give an indication of a maximum resultant flame height of a lighter incorporating the flow restrictor. In practice, a maximum desired flame height may be designated such that a flow restrictor will not permit a flame height beyond the designated flame height. The flow restrictor can then be manufactured according to this specification (i.e., to have a maximum flame height), thus resulting in a flow restrictor of a desirable porosity. In some cases, a specified range of butane flow rate will correspond to a desired flame height. In one example, the desired flame height can be achieved by providing a flow restrictor that establishes butane flow at a rate of 6.5 standard cubic centimeters per minute (sccm)+/−0.75 sccm. Accordingly, flow restrictors can be tested according to this specification. As can be appreciated from the foregoing disclosure, the flow restrictors 26 can be tested prior to placement in lighters, thereby alleviating the need to introduce a combustible fluid into such lighters prior to shipment. In some embodiments, the flow restrictors 26 may alternatively be inserted into a lighter housing prior to testing. In these embodiments, testing can be carried out on lighters incorporating the flow restrictors, yet without the necessity of introducing a combustible fuel into the lighter. That is, a non-combustible fluid can be used to test assembled lighters, thus alleviating the need to fill lighters with a combustible fuel prior to shipment.

Testing of flow restrictors 26 prior to assembly of such flow restrictors into lighters permits the manufacture of "dry" lighters with a known and controlled maximum flame height. As used herein, the term "dry lighter" refers to a lighter, which has not been charged (filled) with fuel. Indeed, use of a non-combustible test gas to measure the flow permitted by flow restrictor 26 allows manufacture of lighters without any parts of the lighter having been placed in contact with the butane fuel.

In practice, flow restrictors 26 that fall within predetermined flow parameters are used in the assembly and manufacture of the lighters, such as lighter 10. Flow restrictors 26 that exceed or fall below the predetermined flow parameters are rejected and not used in the manufacture of lighters. For example, those flow restrictors that are found to not provide for flow of butane or butane-like material within the 6.5 sccm+/−0.75 sccm range are scrapped. The flow rate inspection of the flow restrictor allows for the pre-qualification of the flow restrictor for the assembly of the lighter, and thereby minimizes or eliminates the potential of rejecting partial or completed lighters for not meeting quality and performance requirements for fluid flow rates.

As has been stated, by testing the flow characteristic of the flow restrictor 26 before it is put in the lighter, either through use of a non-combustible fluid or a combustible fuel, the flow characteristic of the flow restrictor 26 for butane fuel in the lighter can be determined. Again, it is to be understood that "butane fuel" may include one form of butane, or may include a mixture of various forms of butane, or may include butane and one or more other gases, or may be one or more other non-butane-containing combustible fuels that are similar to butane.

Using the methods of the present disclosure to verify the flow characteristic for the lighter allows complete assembly of the lighter without it ever having been charged with combustible fuel. Such "dry lighters" have fewer restrictions on shipment for distribution. By providing verification of the flow characteristic, the maximum flame height may be controlled, without having to charge and test the lighter with combustible fuel.

Figure 9:
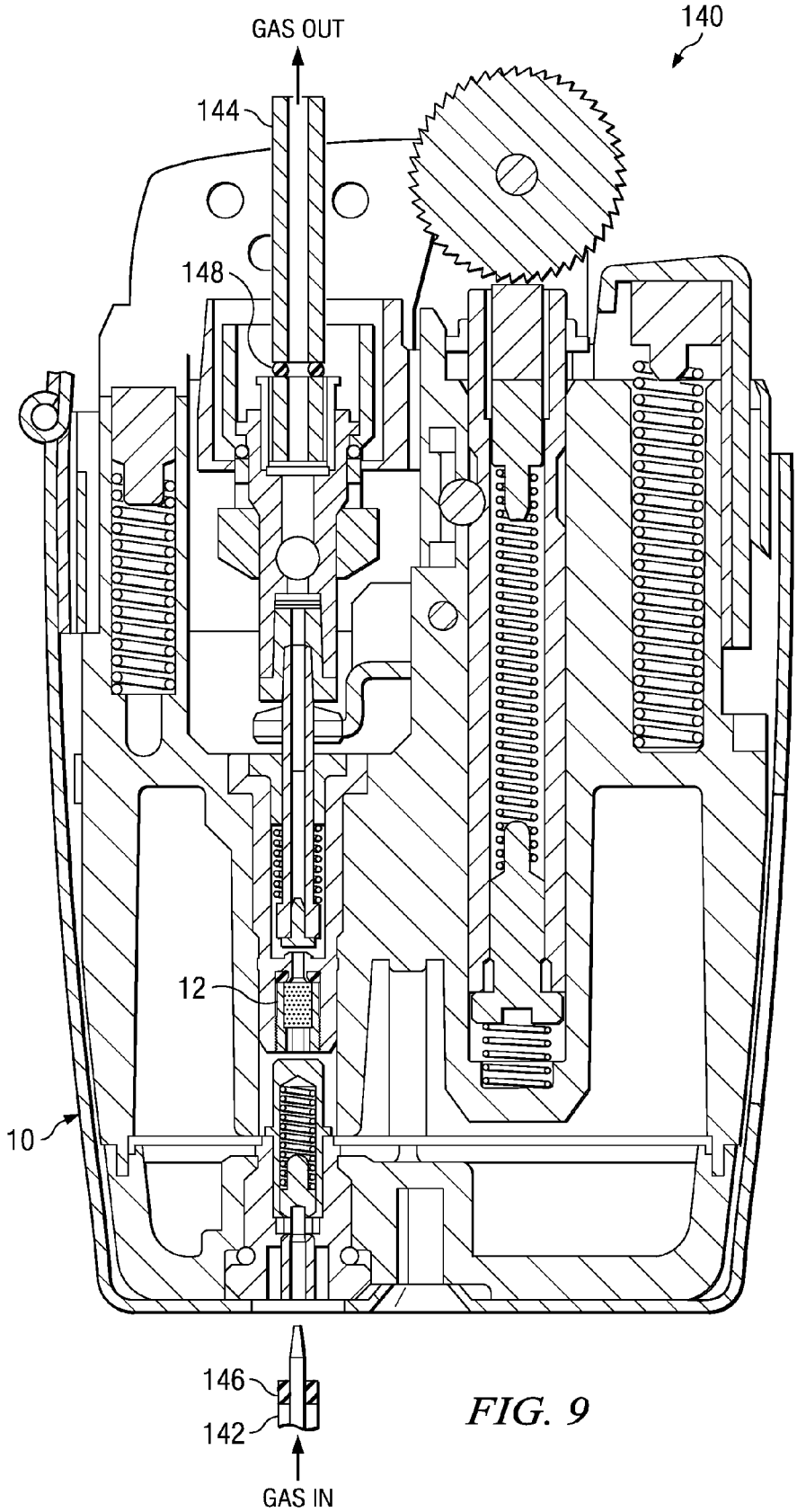
FIG. 9 is a sectional side view showing a test apparatus that interfaces with the lighter of FIG. 1 useful in the practice of the present disclosure.

The testing of the flow restrictor 26 according to the present disclosure may be performed on the flow restrictor alone, or may be performed after the flow restrictor is assembled into the lighter. FIG. 9 shows an exemplary test apparatus 140 designed to interface with a lighter 10 in which a flow restrictor 26 is already assembled in the lighter. Test apparatus 140 includes a gas filler nozzle 142 and a gas exit port 144. Seals 146, 148 ensure a secure fit to avoid leaks of gas. A seal may be effected by applying appropriate pressure on both gas filler nozzle 142 and gas exit port 144. In this embodiment, a non-combustible fluid is used to test the assembled lighter so as to avoid introduction of combustible fuel into the lighter prior to shipment. In operation, gas enters the lighter 10 through the gas filler nozzle 142 and exits through the gas exit port 144. In some embodiments, the fuel tank may be filled with non-combustible fluid to facilitate testing. Testing may be conducted using the test apparatus and methods described above. After testing, any non-combustible fluid in the fuel tank may be extracted and a vacuum may then be drawn on the fuel tank. Providing a refillable lighter with a fuel tank under vacuum would facilitate and enhance the initial filling of the tank with fuel by the consumer, allowing for the fuel to enter the tank without the need to compress the air sealed in the tank during normal manufacturing processes. This allows for the consumer to maximize the initial fill of the tank with fuel.

Figure 10:
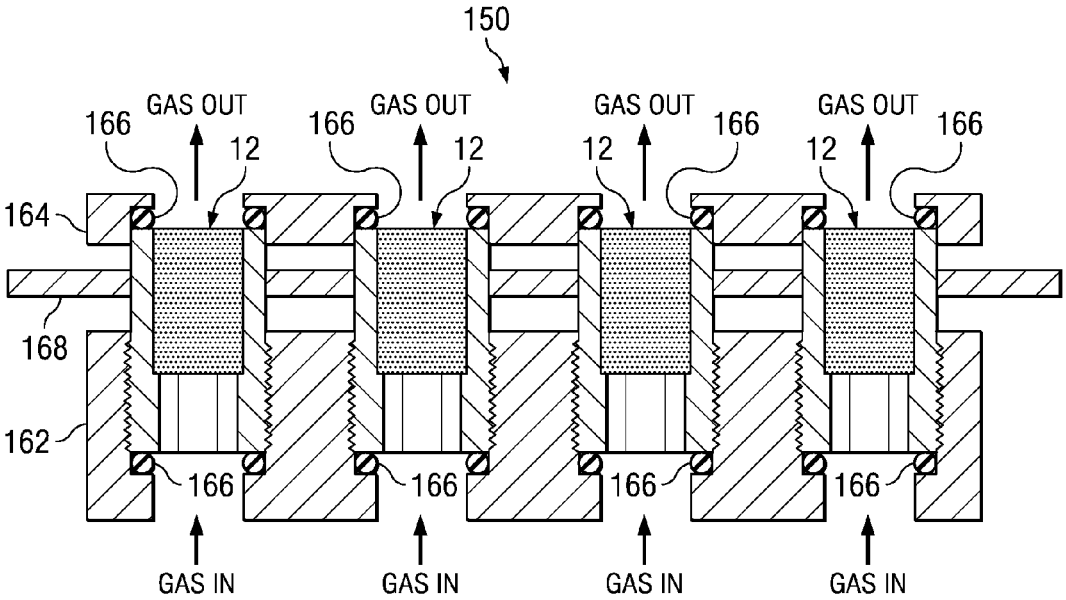
FIG. 10 is a sectional side view of a batch testing apparatus for testing a batch of flow restrictors useful in the practice of the present disclosure.

In a mass production environment, it is also contemplated that flow restrictors may be tested in batches or with sequential automation or with continuous motion automation. A side view of an exemplary batch testing apparatus 150 is illustrated in FIG. 10. Batch testing apparatus 150 includes lower clamp 162, upper clamp 164, and O-rings 166 to provide a seal. Carrier 168 may hold a batch of flow restrictors 26 or flow restrictor assemblies 12, for ease of handling, automation, and distribution. In this exemplary embodiment, carrier 168 provides a four by four array in which to test and handle flow restrictors 26, though it is to be appreciated that the array may have other configurations having various dimensions, shapes, and directions.

Figure 11:
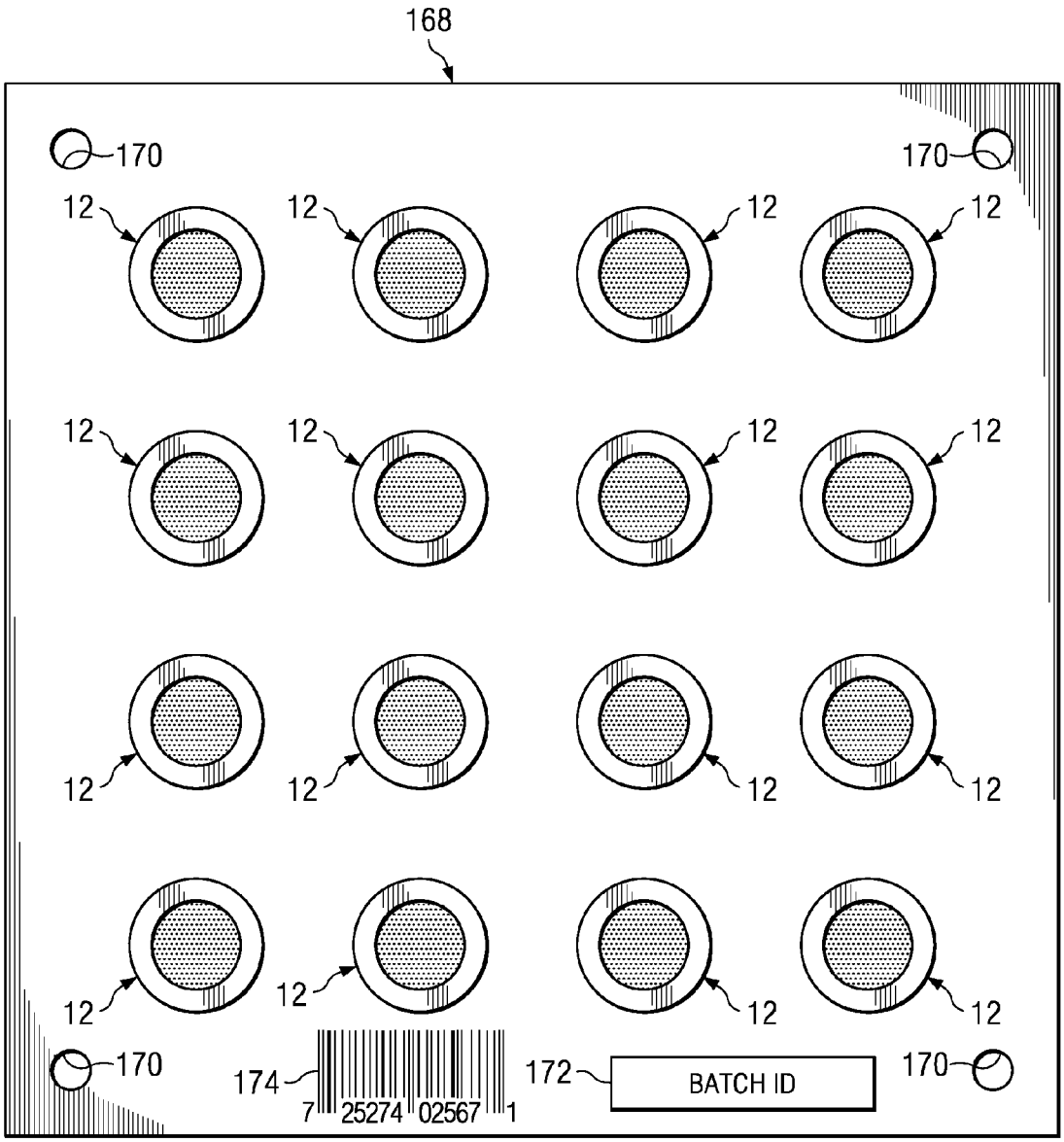
FIG. 11 is a top-down view of an exemplary carrier for holding a batch of flow restrictors, which may be used with the batch testing apparatus of FIG. 10.

Additional features of an exemplary carrier are shown with reference to FIG. 11, which shows a top-down view of carrier 168 carrying a batch of sixteen flow restrictors 26. Carrier 168 may include alignment guides 170 in each corner to aid positioning and alignment of the batch, a batch identification label 172, and a bar code 174 for automated batch identification. Batch identification label 172 and bar code 174 may identify the batch, as well as other associated batch details, such as origin and manufacturer.

Operationally, a batch may be tested using a similar technique to that described above regarding testing a single flow restrictor 26. Flow restrictors may be tested all at once (i.e., in parallel), or sequentially (i.e., in series), and the volumetric flow characteristics may be calculated by a computer. Batch results may be stored and analyzed, and the results used to accept or reject a single flow restrictor 26 or a batch of flow restrictors.

Additionally, testing of flow restrictor 26, whether as an individual component, assembled in a lighter, or in a batch, may be performed on a statistical sampling basis or on a 100% manufacturing basis. By "100% manufacturing basis" it is meant that every flow restrictor assembled into a lighter is flow tested to verify that it meets the predetermined flow characteristic specification.

While various embodiments of lighters with flow restrictors and methods of manufacturing and testing such flow restrictors according to the principles disclosed herein have been described above, it should be understood that they have been presented by way of example only, and not limitation. For example, in embodiments where a combustible fuel is used to test flow restrictors prior to assembly into a lighter, the flow restrictor may undergo a venting procedure after testing to substantially fully release the residual fuel before being inserted into a lighter. Or the flow restrictor may be purged with another fluid (e.g. air or an inert gas) to expel any residual fuel. Rather, the following claims should be construed broadly to cover any embodiment tailored to achieve the principles disclosed herein. Thus, the breadth and scope of the invention(s) should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically and by way of example, although the headings refer to a "Technical Field," such claims should not be limited by the language chosen under this heading to describe the so-called technical field. Further, a description of a technology in the "Background" is not to be construed as an admission that technology is prior art to any invention(s) in this disclosure. Neither is the "Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

What is claimed is:

1. A method of manufacturing a lighter, the method comprising:

providing a flow restrictor;

providing a lighter housing adapted to receive the flow restrictor, the lighter housing having a fuel tank;

assembling the flow restrictor into the lighter housing, the lighter housing being adapted to receive a non-combustible fluid initially into the fuel tank;

directing the non-combustible fluid through the flow restrictor;

measuring a flow rate of the non-combustible fluid through the flow restrictor extracting the non-combustible fluid from the lighter housing; and drawing a vacuum on the fuel tank.

2. A method according to claim 1, further comprising analyzing the flow rate of the non-combustible fluid through the flow restrictor against a specified range of flow rates, the specified range of flow rates corresponding to a specified range of flow rates of a combustible fluid.

3. A method according to claim 2, the method further comprising:

when the measured flow rate is within the specified range, accepting the lighter.

4. A method according to claim 2, the method further comprising:

when the measured flow rate is outside the specified range, rejecting the lighter.

5. A method according to claim 2, wherein the correlation of the measured flow rate of the non-combustible fluid to the flow rate of the combustible fluid indicates a maximum flame height.

6. A method according to claim 1, wherein directing a non-combustible fluid through the flow restrictor comprises directing inert gas through the flow restrictor.

7. A method according to claim 1, wherein directing a non-combustible fluid through the flow restrictor comprises directing air or nitrogen through the flow restrictor.

8. A method according to claim 1, wherein the flow restrictor is a porous member.

9. A method according to claim 1, wherein the flow restrictor is a tube having an internal diameter that restricts flow rate therethrough.

* * * * *